US006113126A

United States Patent [19]

Zanco et al.

[11] Patent Number: 6,113,126

[45] Date of Patent: Sep. 5, 2000

[54] GLIDING BOARD WITH SIDE REINFORCING ELEMENTS PRESENT OVER A PORTION OF THE RUNNING LENGTH

[75] Inventors: Alain Zanco; Denis Redor, both of Voiron, France

[73] Assignee: Skis Rossignol S.A., Voiron, France

[21] Appl. No.: 09/238,315

[22] Filed: Jan. 28, 1999

[30] Foreign Application Priority Data

Jan. 28, 1998 [FR] France ..... 98 01178

[51] Int. Cl.[7] ..... A63C 5/07

[52] U.S. Cl. ..... 280/610; 280/602; 280/609

[58] Field of Search ..... 280/602, 608, 280/609, 610, 607, 14.2

[56] References Cited

U.S. PATENT DOCUMENTS

| | | | |
|---|---|---|---|
| 4,300,786 | 11/1981 | Alley . | |
| 5,288,097 | 2/1994 | Pascal et al. | 280/610 |
| 5,292,148 | 3/1994 | Abondance et al. | 280/610 |
| 5,544,908 | 8/1996 | Fezio | 280/610 |
| 5,553,884 | 9/1996 | Abondance | 280/610 |
| 5,599,036 | 2/1997 | Abondance et al. | 280/610 |

FOREIGN PATENT DOCUMENTS

| | | |
|---|---|---|
| 0 543 743 A1 | 11/1992 | European Pat. Off. . |
| 0 620 027 A1 | 4/1994 | European Pat. Off. . |

*Primary Examiner*—Richard M. Camby
*Attorney, Agent, or Firm*—Wall Marjama Bilinski & Burr

[57] ABSTRACT

A board for gliding over snow is provided which is structured such that it has a central support region having a cross-section selected from the group consisting of the sandwich cross-section, the shell cross-section, and the hybrid cross section; a front region located between and connecting the central region and a tip; and a rear region located between and connecting the central region and a tail portion. The front region, central support region, and rear region each may have either a sandwich cross-section, a shell cross-section, and a hybrid cross section. The sandwich cross-section can have a first upper layer, a first upper reinforcement layer, a first core, a plurality of longitudinal reinforcing elements, a first lower reinforcement, a first sole, and a plurality of first edges. The shell cross-section may have a second upper layer, a second upper reinforcement layer, a second core, a plurality of second reinforcing elements inclined over the entire height of the sides of the board, a second lower reinforcement, a second sole, and a plurality of second edges. Alternatively, the shell cross-section could be constructed having a third upper layer in contact with a third upper reinforcement layer, the third upper layer and the third upper reinforcement layer extending downward over a third core until the third upper reinforcement layer contacts a third lower reinforcement which is in contact with a third sole having a plurality of third edges. The hybrid cross-section can have a shell half-structure comprising a fourth upper layer and a fourth upper reinforcement layer, a fourth core, a plurality of fourth longitudinal reinforcing elements, a fourth lower reinforcement, a fourth sole, and a plurality of fourth edges.

9 Claims, 2 Drawing Sheets

GLIDING BOARD WITH SIDE REINFORCING ELEMENTS PRESENT OVER A PORTION OF THE RUNNING LENGTH

FIELD OF THE INVENTION

The invention relates to the field of gliding sports. It concerns the structure of a gliding board and, more particularly, the external shape of such a board. It more particularly pertains to the presence and the height of lateral reinforcing elements located at the sides. Although, in the rest of the description, the invention is more specifically described in the application to alpine skiing, it is readily adaptable to other types of gliding boards, such as a snow board, a monoski and a cross-country ski.

BACKGROUND OF THE INVENTION

As is known, boards for gliding over snow have different structures in order to meet a variety of criteria, in particular of performance and response. Thus, a first family of boards is known whose structure consists of a stack of successive layers, namely a sole and edges intended to come into contact with the snow, a core constituting the heart of the ski, reinforcements, and an upper assembly supporting the trim.

As is known, the core is generally bordered by reinforcing elements present over the entire length of the ski, or more precisely over all of its running length, that is to say the length of the ski lying between the front and rear contact lines. Such reinforcing elements can be seen on the sides of the ski. These reinforcing elements are used as components for transmitting forces from the upper face of the ski to the edges. In this way, the forces exerted by the skier, in particular in the turn initiation phase, are efficiently transmitted to the edges. A "sandwich" structure of this type therefore has a certain flexibility with specific features imparted by the shear effect generated between the layers when the ski bends.

Skis produced with this structure are particularly efficient at high speed because they maintain optimum contact with the snow. These skis are therefore accurate and fast, albeit somewhat difficult to steer under certain run and snow conditions.

Further, another type of structure, commonly referred to as the "box" structure, consists in covering at least a portion of the core with a reinforcement fabric, this type of tubular reinforcing being different from the laminar reinforcing in the previous structure.

Skis produced with this "box" structure are torsionally stronger. They make it possible to set the edges more efficiently, and therefore allow better accuracy during turns.

A variant of this "box" structure is commonly referred to as a "shell" structure. Such a gliding board has edges which are free from extra longitudinal reinforcing elements.

In such a structure, the upper reinforcement layer is laterally extended within the sides until it comes close to the edges. The lack of a longitudinal reinforcing element in the sides makes such a board weaker in terms of bearing strength on the edge. Such a ski is therefore less reactive and facilitates more comfortable and more forgiving skiing. Side slipping is thus easier to perform with this "shell" structure.

Further, from the Applicant's Patent FR 2 703 916 corresponding to U.S. Pat. No. 5,553,884, a ski is also known which combines, over a portion of its length, a "shell" upper structure and, over the lower portion, a "sandwich" structure including reinforcing elements located at the sides, and supporting said shell.

In practice, although satisfactory, such a ski has mediocre qualities in terms of torsional rigidity and capability, which correspond neither to the highly responsive nature of a stacked structure nor to the forgiving nature of a pure "shell" structure.

SUMMARY OF THE INVENTION

The problem which the invention therefore proposes to solve is that of adapting the mechanical properties of a gliding board in order to accommodate the different types of skiing, and to optimize its mechanical properties according to the response desired from said board.

The invention therefore relates to a board for gliding over snow whose running length consists:

- of a central or support region;
- of a front region lying between the tip and the central region;
- of a rear region lying between the central region and the tail, the sides of which are equipped with lateral reinforcing elements present over at least a portion of the running length of the board.

Such a board is one wherein:

- at least a first portion of the running length has a so-called "sandwich" structure which includes lateral reinforcing elements present over virtually the total height of the side of the board;
- at least a second portion of the running length has a so-called "shell" structure free from lateral reinforcing elements;
- the interface regions between said first and second portions include lateral reinforcing elements having a height which decreases progressively from the total height of the side in the first region to a zero value.

In other words, the invention consists in producing a board which combines three different structures, a "sandwich" structure, a "shell" structure and a hybrid structure, in order to optimize the overall response of the board according to the particular response of the structures in each of the regions of the board.

A reinforcing element should, of course, be considered to be present over the total height of the side if it essentially occupies the height of this side, apart from the thickness of the sole and the upper protective layer.

A large number of structural combinations can be obtained in this way.

Clearly, the invention is not limited to the case in which the ski is symmetrical, and on the contrary covers variants in which the reinforcing elements are located differently on the outer edge and on the inner edge, corresponding to the opposite edges when the skier has put on the two skis.

In a range of products, it is known to provide skis for all types of users and for all possible conditions of use.

For example, the following types of skis may be identified:

- an undemanding, comfortable and secure ski which side slips for skiing on prepared runs. This ski is intended for beginners;
- a technical, accurate and fast ski for skiing turns on prepared runs. This ski is intended for proficient or advanced skiers;
- a pivoting ski having good lift, for off-piste skiing in powder snow;
- a ski which is highly flexible under the foot and catches well at the ends, that is to say one which is torsionally rigid for skiing tight turns.

BRIEF DESCRIPTION OF THE DRAWINGS

The way in which the invention can be embodied, as well as the advantages which result from this, will be readily apparent from the description of the embodiments which follow, with reference to the appended figures in which.

DESCRIPTION OF THE PREFERRED EMBODIMENT

As already mentioned, the invention concerns a gliding board whose various regions, distributed over its running length, have different structures tailored according to the mechanical properties required for optimum performance.

More precisely, the various configurations used are illustrated in FIGS. 2 to 5.

Figure 2:
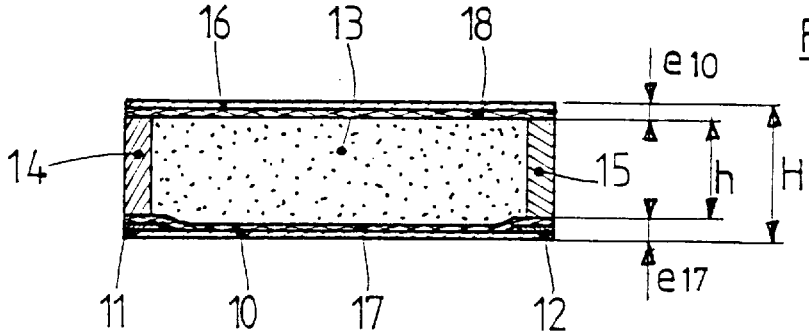
FIG. 2 is a cross-sectional view of the "sandwich" zone of a ski according to the invention, this section having sides with a height substantially equal to the height of the board.

Thus, in a first structure which is illustrated in FIG. 2, the ski includes a sole (10) which is intended to come into contact with the snow and is bordered by metal edges (11, 12). On its upper face, this sole (10) accommodates a lower reinforcement (17) and a core (13) which can be produced using various techniques, and is fitted either by mechanical assembly or by in situ injection. The core (13) is covered with an upper reinforcement (18).

In the conventional way, this structure includes reinforcing elements (14, 15) on each flank of the core, which form the sides of the ski. In one of the characteristic regions of the invention, these reinforcing elements have a height h equal to that H of the side of the ski, except for the thicknesses ($e_{10}$ , $e_{17}$) of the sole (10) and of the upper layer (17).

Figure 3:
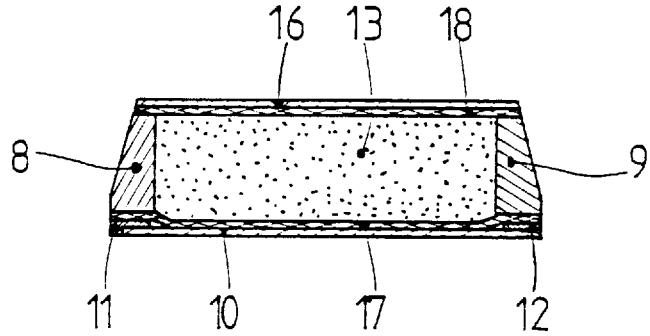
FIG. 3 is an alternative embodiment of the "shell" region in FIG. 2.

An alternative embodiment of this structure is illustrated in FIG. 3. In this case, the sides (8, 9) of the reinforcing elements (14, 15) are inclined over the entire height of the ski.

In a region including such a structure, generally referred to as a "sandwich" structure, the stack of different layers gives rise to a specific kind of response. This is because, when the ski deforms, the bonding or connecting regions between layers experience a shear which gives the ski particular response on the snow. This structure allows very good ski/snow contact, limiting the "chatter" effect, and it further allows efficient support on the edges. This structure is quite highly responsive although flexible, especially in torsion.

Figure 4:
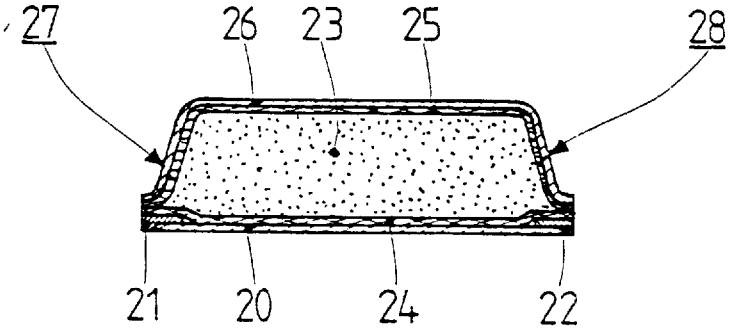
FIG. 4 is a cross-sectional view of the "shell" region of a ski according to the invention, this region being free from reinforcing elements at the sides.

By contrast, the structure illustrated in FIG. 4, more generally referred to as a "shell" structure, also includes a sole (20) bordered by edges (21, 22) as well as a core (23), reinforcements (24) and (25) and an upper layer (26). In this case, the sides (27, 28) of the structure do not, strictly speaking, include longitudinal reinforcing elements. Only the upper reinforcement (25) descends to the edges (26) and (29), but without providing very effective support on the edges.

The upper layer (26), covering the upper face of the ski, extends along the inclined lateral regions until it is close to the metal edges (21, 22).

Because it allows the core to be enclosed in a tubular box, such a structure reinforces the torsional strength of the core, and therefore of the entire structure (which is not the case as regards the "sandwich" structure in FIGS. 2 and 3), while maintaining a good capacity for flexural deformation.

When used in the support region, this type of structure will provide the skier with comfort because the pressures are not too dynamic. On the other hand, this structure will allow the ends of the ski to resist torsional deformations, which will allow good execution of turns when settings the edges.

Figure 5:
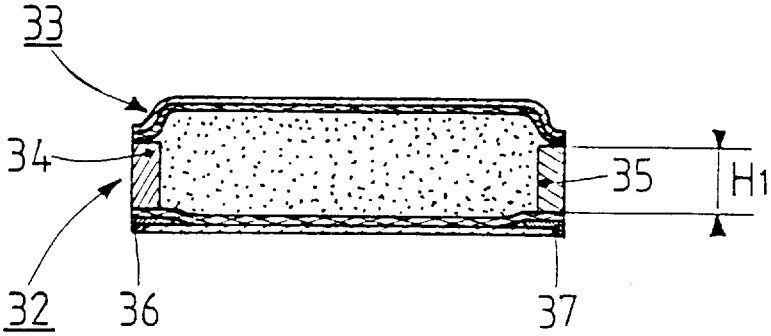
FIG. 5 is a cross-sectional view of the hybrid region of a ski according to the invention, this region having an intermediate structure including reinforcing elements present at the edges only over part of the height of the ski.

Certain regions of the ski, in particular those lying at the interface between the "sandwich" and "shell" regions have a structure as illustrated in FIG. 5, in which a "shell" half-structure (33) can be seen in the upper part, and a "sandwich" half-structure (32), having reinforcing elements (34, 35) bearing on the metal edges (36, 37) can be seen in the lower part.

Figure 6:
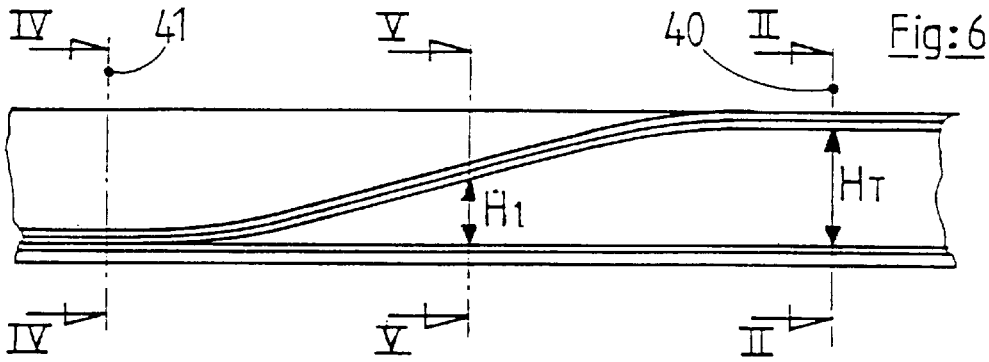
FIG. 6 is a side view of a ski according to the invention in the interface region between the characteristic regions.

The side height $H_1$ in the interface region illustrated in FIG. 6 varies from a maximum height $H_T$, corresponding to a "sandwich" region (40) illustrated in FIGS. 2 and 3, to a zero value, corresponding to the "shell" region (41) illustrated in FIG. 4.

These various zones can be distributed in different ways over the length of the ski, according to the families described below.

Figure 1:
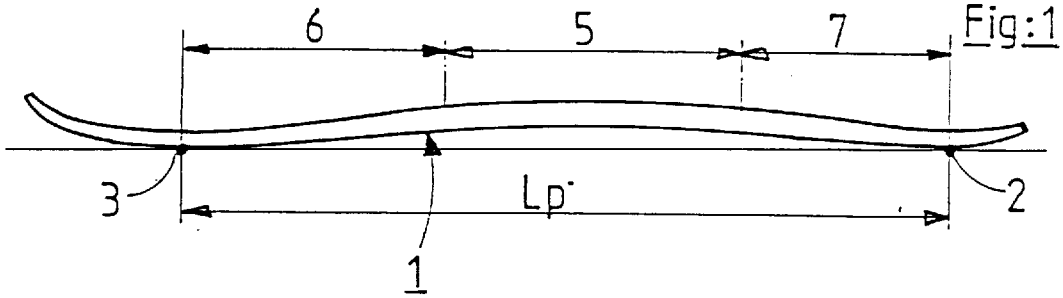
FIG. 1 is a side view of a ski, allowing approximate definition of the different tail, support and tip regions.

In general, FIG. 1 illustrates a ski (1) in which three regions can be defined over the running length ($L_r$) of the ski. The running length ($L_r$) is generally defined as being the region lying between the front (3) and rear (2) contact lines of the ski. This running length ($L_r$) is divided into a central region, referred to as the support region (5), a front region (6) between the tip and the support region, and a rear region (7) between the support region and the tail.

Different combinations of the characteristic structures have specific benefits according to the way in which the user skis.

First Embodiment

Figure 7:
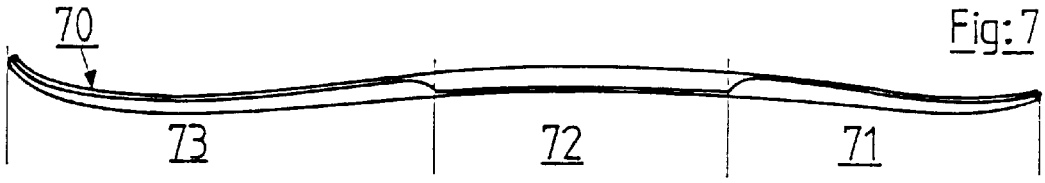
FIG. 7 is a side view of a ski according to a first embodiment, more particularly suitable for beginners.

The ski (70) illustrated in FIG. 7 includes a rear region (71) and a front region (73) with "sandwich" structure, and a support region (72) with "shell" structure. In this way, the ski (70) is fairly flexible in the support region, which allows maximum flexion under the feet and therefore a very good curve on its edge, and the edge setting is also made less severe because of the "shell" structure under the feet. The "sandwich"-structure ends are not too stiff torsionally. This configuration is particularly beneficial for those learning to ski.

Second Embodiment

Figure 8:
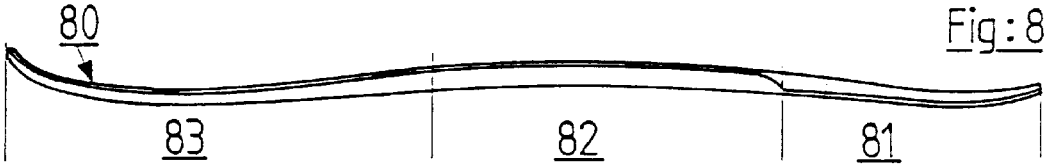
FIG. 8 is a side view of a ski according to a second family of embodiments, corresponding to a competition ski.

FIG. 8 illustrates a ski (80) which includes a rear region (81) with "shell" structure, while the support region (82) and the front region (83) have a "sandwich" structure in which the lateral reinforcing elements are present over the entire height of the side. Such a ski therefore has very firm edge support in its central portion (82), and is torsionally flexible in the front region (83) while the rear region (81) maintains good torsional rigidity. Such a ski (80) thus ensures good contact when it is flat on the snow then, when initiating and at the start of turning, since the edge setting is very firm, the ski follows the curve perfectly and, finally, when exiting the turn, the ski maintains good torsional rigidity which avoids side slipping and thus avoids losing accuracy and time.

Third Embodiment

Figure 9:
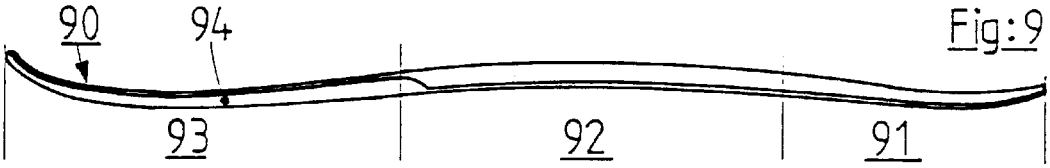
FIG. 9 is a side view of a ski according to a third family of embodiments according to the invention, more particularly suitable for powder snow skiing.

FIG. 9 illustrates a third configuration (90), in which the rear (91) and support (92) regions have a "shell" structure while the front region (93) has a "sandwich" structure in which the lateral reinforcing elements (94) are present over the entire height of the board.

On such a ski (90), the "shell" central portion (92) favors a form of skiing in which the edge setting is not too harsh.

Further, the "shell" structure at the rear end (91) makes it easier to direct the ski.

The presence of the "sandwich" structure at the front (93) allows the ski to be placed on the snow better. In this way, the ski (90) is particularly suitable for skiing off piste or in powder snow.

Fourth Embodiment of the Invention

Figure 10:
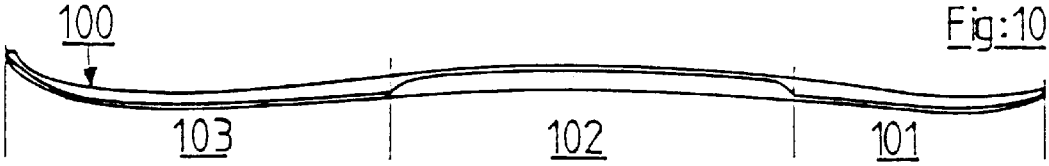
FIG. 10 is a side view of a ski according to a fourth family of embodiments, specialized in the practice of skiing with tight turns, illustrated according to an alternative embodiment in FIG. 11.
Figure 11:
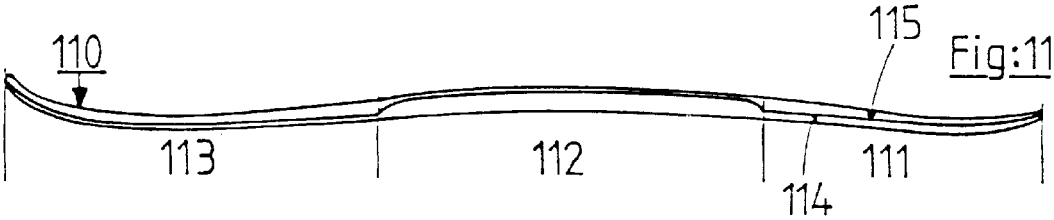

FIGS. 10 and 11 illustrate two alternative embodiments presenting fairly similar features and having similar responses on the snow. Such skis (100, 110) have a support region (102, 112) with "sandwich" structure and a front region (103, 113) in "shell" structure. In the form illustrated in FIG. 10, the rear region (101) is with a "shell" structure, while the rear region (111) in FIG. 11 has a "hybrid" structure, that is to say including lateral reinforcing elements typical of a "sandwich" structure in the lower portion (114), and a "shell" structure in the upper portion (115).

By virtue of the opportunities for effective support on the edges in the central portion, such skis (100, 110) thus have a high degree of accuracy, allowing the edge line to be followed without side slipping. The "shell" structure ends make it easier to withstand the torsional forces which are particularly pronounced when skiing tight turns.

In the case in FIG. 11, the tail region has a hybrid structure, the response of which is more comfortable because the torsional rigidity characteristics are less harsh for the lower "sandwich" portion.

What is claimed is:

1. A board for gliding over snow, comprising:

a central support region;

a front region lying between the central region and the tip;

a rear region lying between the central region and the tail, the sides of which are equipped with lateral reinforcing elements present over at least a portion of the running length of the board, wherein:

at least a first portion of the running length has a sandwich structure which includes lateral reinforcing elements present over virtually the total height H of the side of the board;

at least a second portion of the running length has a shell structure free from lateral reinforcing elements and the interface regions between said first and second portions include lateral reinforcing elements having a height $H_1$ which decreases progressively from the total height $H_T$ of the side in the first region to a zero value.

2. The gliding board as recited in claim 1, wherein said first portion with sandwich structure which has lateral reinforcing elements extends over the rear region of the gliding board, and wherein said second portion with shell structure extends over at least one of the two support or front regions of the gliding board.

3. The gliding board as recited in claim 1, wherein the first portion with sandwich structure which has lateral reinforcing elements extends over at least one of the two support or front regions of the gliding board, and wherein the second portion with shell structure extends over the rear region of the gliding board.

4. The gliding board as recited in claim 1, wherein said first portion with sandwich structure which has lateral reinforcing elements extends over the front region of the gliding board, and wherein said second portion with shell structure extends over at least one of the two support or rear regions of the gliding board.

5. The gliding board as recited in claim 1, wherein the first portion of the sandwich type which has lateral reinforcing elements extends over at least one of the two support or rear regions of the gliding board, and wherein the second portion with shell structure extends over the front region of the gliding board.

6. The gliding board as recited in claim 1, wherein:

the central region has a shell structure;

the front and rear regions have a structure of the sandwich type, on which the lateral reinforcement elements are present over the total height of the sides.

7. The gliding board as in claim 1, wherein:

the central region has a structure of the sandwich type on which the lateral reinforcement elements are present over the total height of the sides;

the front and rear regions have a shell structure.

8. The gliding board as recited in claim 7, which includes, over one of the portions constituting the rear region, the support region or the front region:

a low part having lateral reinforcing elements, an upper part forming a shell structure.

9. The gliding board as recited in claim 8, wherein the reinforcing elements are located differently on the inner edge and on the outer edge, when the skis are put on the user's feet.

* * * * *